US006526750B2

(12) United States Patent
Bliesner et al.

(10) Patent No.: US 6,526,750 B2
(45) Date of Patent: Mar. 4, 2003

(54) REGENERATOR FOR A HEAT ENGINE

(75) Inventors: Wayne T. Bliesner, Bothell, WA (US); Brian J. Bileau, Monroe, WA (US); Gerald R. Fargo, Woodinville, WA (US)

(73) Assignee: Adi Thermal Power Corp., Woodinville, WA (US)

( * ) Notice: Subject to any disclaimer, the term of this patent is extended or adjusted under 35 U.S.C. 154(b) by 0 days.

(21) Appl. No.: 09/912,095

(22) Filed: Jul. 23, 2001

(65) Prior Publication Data

US 2001/0039801 A1 Nov. 15, 2001

Related U.S. Application Data

(63) Continuation-in-part of application No. 09/500,185, filed on Feb. 7, 2000, now Pat. No. 6,263,671, which is a continuation-in-part of application No. 08/971,235, filed on Nov. 15, 1997, now Pat. No. 6,041,598.

(51) Int. Cl.[7] ..... F01B 29/10
(52) U.S. Cl. ..... 60/517; 60/526
(58) Field of Search ..... 60/517, 526; 165/4, 165/10, 165

(56) References Cited

U.S. PATENT DOCUMENTS

| | | | | |
|---|---|---|---|---|
| 3,949,554 A | | 4/1976 | Noble et al. | |
| 4,013,117 A | * | 3/1977 | Kpoetzki et al | 165/10 |
| 4,093,435 A | * | 6/1978 | Morron et al. | 55/269 |
| 4,174,616 A | | 11/1979 | Nederlof et al. | |
| 4,200,441 A | * | 4/1980 | Honmann et al. | 55/181 |
| 4,405,010 A | | 9/1983 | Schwartz | |
| 4,425,764 A | | 1/1984 | Lam | |
| 4,429,732 A | | 2/1984 | Moscrip | |
| 4,607,424 A | | 8/1986 | Johnson | |
| 4,662,176 A | | 5/1987 | Fujiwara et al. | |

(List continued on next page.)

FOREIGN PATENT DOCUMENTS

| | | |
|---|---|---|
| DE | 2519869 | 11/1976 |
| WO | WO82/00320 | 2/1982 |

OTHER PUBLICATIONS

Knowles, Timothy R. ; Composite–Matrix Regenerators for Stirling Engines; NASA Tech Briefs LEW–16581 Jan. 1997, NASA USA.

*Primary Examiner*—Hoang Nguyen
(74) *Attorney, Agent, or Firm*—Dowrey & Associates

(57) ABSTRACT

A multi-channel thermal regenerator for a heat engine comprising a coiled annulus of thin high-temperature sheet material coiled so that individual coils are in spaced substantially parallel arrangement in an annular configuration. In one embodiment the sheet material is approximately 0.002 inch thick stainless steel embossed in a rectangular array with approximately 0.008 inch high protruding dimples that space the coils. In another embodiment the sheet material is carbon having a plurality of fibers oriented generally circumferentially around the coiled annulus providing a higher thermal conductivity in a direction along the fibers. A ceramic string is woven between the coils radially across the annulus at a plurality of locations around the annulus to space the coils. The coiled annulus is preferably contained in a cartridge having a substantially open cage base with a plurality of bars that space the end of the coiled annulus from adjacent engine structure.

20 Claims, 2 Drawing Sheets

U.S. PATENT DOCUMENTS

| | | | | |
|---|---|---|---|---|
| 4,742,679 | A | | 5/1988 | Inoda et al. |
| 4,799,421 | A | | 1/1989 | Bremer et al. |
| 4,815,290 | A | | 3/1989 | Dunstan |
| 4,832,118 | A | | 5/1989 | Scanlon et al. |
| 4,894,989 | A | | 1/1990 | Mizuno et al. |
| 5,074,114 | A | | 12/1991 | Meijer et al. |
| 5,140,905 | A | | 8/1992 | Dhar |
| 5,217,681 | A | | 6/1993 | Wedellsborg et al. |
| 5,242,015 | A | | 9/1993 | Saperstein et al. |
| 5,339,653 | A | | 8/1994 | DeGregoria |
| 5,355,679 | A | | 10/1994 | Pierce |
| 5,383,334 | A | | 1/1995 | Kaminishizono et al. |
| 5,388,410 | A | | 2/1995 | Momose et al. |
| 5,429,177 | A | | 7/1995 | Yaron et al. |
| 5,433,078 | A | | 7/1995 | Shin |
| 5,465,781 | A | * | 11/1995 | DeGregoria ..... 165/8 |
| 5,555,729 | A | | 9/1996 | Momose et al. |
| 5,611,201 | A | | 3/1997 | Houtman |
| 5,715,683 | A | | 2/1998 | Hofbauer et al. |
| 6,041,598 | A | * | 3/2000 | Bliesner ..... 60/517 |
| 6,263,671 | B1 | * | 7/2001 | Bliesner ..... 60/517 |
| 6,347,453 | B1 | * | 2/2002 | Mitchell ..... 29/890.034 |

* cited by examiner

REGENERATOR FOR A HEAT ENGINE

CROSS REFERENCE TO RELATED APPLICATIONS

This application is a continuation-in-part application of pending U.S. patent application Ser. No. 09/500,185 filed on Feb. 7, 2000 (Now U.S. Pat. No. 6,263,671), which is a continuation-in-part of U.S. patent application Ser. No. 08/971,235 filed on Nov. 15, 1997 (Now U.S. Pat. No. 6,041,598). The above referenced patent applications are hereby incorporated herein by reference.

BACKGROUND OF INVENTION

1. Field of the Invention

The present invention relates, generally, to heat engines. More particularly, the invention relates to Stirling cycle heat engines with a cylinder containing a working fluid and a piston moving therein.

2. Background Information.

The maximum Stirling engine efficiency is related to the Carnot efficiency which is governed by the ratio of maximum working fluid temperature relative to the minimum fluid temperature. Improvements in technologies which increase the margin between the two temperature extremes is beneficial in terms of total cycle efficiency. The lower working fluid temperature is typically governed by the surrounding air or water temperature; which is used as a cooling source. The main area of improvements result from an increase in the maximum working temperature. The maximum temperature is governed by the materials which are used for typical Stirling engines. The materials, typically high strength Stainless Steel alloys, are exposed to both high temperature and high pressure. The high pressure is due to the Stirling engines requirement of obtaining useful power output for a given engine size. Stirling engines can operate between 50 to 200 atmospheres internal pressure; for high performance engines.

Since Stirling engines are closed cycle engines, heat must travel through the container materials to get into the working fluid. These materials typically are made as thin as possible to maximize the heat transfer rates. The combination of high pressures and temperatures has limited Stirling engine maximum temperatures to around 800° C. Ceramic materials have been investigated as a technique to allow higher temperatures, however their brittleness and high cost have made them difficult to implement.

U.S. Pat. No. 5,611,201, to Houtman, shows an advanced Stirling engine based on Stainless Steel technology. This engine has the high temperature components exposed to the large pressure differential which limits the maximum temperature to the 800° C. range. U.S. Pat. No. 5,388,410, to Momose et al., shows a series of tubes, labeled part number 22 a through d, exposed to the high temperatures and pressures. The maximum temperature is limited by the combined effects of the temperature and pressure on the heating tubes. U.S. Pat. No. 5,383,334 to Kaminishizono et al, again shows heater tubes, labeled part number 18, which are exposed to the large temperature and pressure differentials. U.S. Pat. No. 5,433,078, to Shin, also shows the heater tubes, labeled part number 1, exposed to the large temperature and pressure differentials. U.S. Pat. No. 5,555,729, to Momose et al., uses a flattened tube geometry for the heater tubes, labeled part number 15, but is still exposed to the large temperature and pressure differential. The flat sides of the tube add additional stresses to the tubing walls. U.S. Pat. No. 5,074,114, to Meijer et al., also shows the heater pipes exposed to high temperatures and pressures.

The Stirling engine disclosed in the inventor's U.S. Pat. No. 6,041,598 overcomes the limitations and shortcomings of the above prior art by providing a dual shell pressure chamber. An inner shell surrounds the heat transfer tubing and the regenerator. The portion surrounding the heat transfer tubing contains a thermally conductive liquid metal to facilitate heat transfer from a heat source to the heat transfer tubing and also to transmit external pressure to the heat transfer tubing. An outer shell that acts as a pressure vessel surrounds the inner shell and contains a thermally insulating liquid between the inner and outer shells. Pressure of the working fluid as it flows through the regenerator is transmitted through the inner shell to the insulating liquid and back across the inner shell to the liquid metal surrounding the heat transfer tubing. This system tends to balance the pressure across the heat transfer tubing and the inner shell, thereby allowing the engine to operate with the working fluid at a high pressure to generate significant power while keeping the wall of the heat transfer tubing thin to facilitate heat transfer through it.

A component in all the Stirling engines which is critical to the maximum performance is the regenerator. This device must heat and cool the working fluid for each cycle of the engine which may be 20 to 100 times per second. Past regenerators typically have been made of fine mesh screens very densely packed into layers which are 100's of screens thick. The fine screens and multiple layers are required to meet the high heat transfer rate requirements. These screen regenerators have significant pressure drop as the working fluid, typically Helium, Hydrogen, or air moves through the mesh at high speeds. The performance of the Stirling engine is thusly limited by the use of mesh screens. Other regenerators have used random metal matrix materials and felt with steel filaments oriented primarily perpendicular to the flow direction. Again there are significant pressure drops associated with use of those materials.

Pressure drop through a regenerator can be reduced by using a regenerator that has parallel-duct flow channels, but the surface area must be very large to achieve the necessary heat transfer. U.S.. Pat. No. 5,388,410, to Momose et al., shows a mesh regenerator (No. 25) located inside the heating and cooling tubes, and an improved regenerator (No. 26) that uses a series of small annular pipes placed inside the heater pipe. The maximum heat transfer rate is limited by the minimum pipe diameter. The small tubes also touch each other on their exterior which blocks the working fluid flow.

For very small Stirling engines a single annular slot has been used with success. The slot reduces the pressure drop but its effectiveness is limited by the amount of surface area in a single slot regenerator.

The present invention provides a regenerator for a Stirling engine which overcomes the limitations and shortcomings of the prior art.

SUMMARY OF INVENTION

The present invention provides a multi-channel thermal regenerator for a heat engine comprising a coiled annulus of thin high-temperature sheet material coiled so that individual coils are in a spaced substantially parallel arrangement in an annular configuration. Adjacent coils form channels for moving fluid therethrough such that heat is transferred between a fluid moving through the channels and the coils with a minimum pressure drop in the fluid.

In one embodiment the sheet material is made of metal, preferably stainless steel approximately 0.002 inches thick and embossed, preferably in a rectangular array in order to leave open channels, with protruding dimples that protrude approximately 0.008 inches from the surface to space the coils.

In another embodiment the sheet material is made of carbon having a plurality of fibers oriented generally circumferentially around the coiled annulus providing a higher thermal conductivity in a direction along the fibers. A ceramic string is preferably woven between the coils radially across the annulus at a plurality of locations around the annulus to space the coils.

The coiled annulus is preferably contained in a cartridge having an inner sleeve and an outer sleeve in a spaced parallel arrangement from the inner sleeve with the coiled annulus being disposed therebetween. A cage base connects the inner sleeve and outer sleeve at one end of both sleeves. The cage base has a plurality of bars adjacent an end of the coiled annulus for spacing the end of the coiled annulus from an engine structure against which the cartridge is installed.

The features, benefits and objects of this invention will become clear to those skilled in the art by reference to the following description, claims and drawings.

DETAILED DESCRIPTION

In the following description of the invention, the components are illustrated and described in a vertical orientation with the cylinder located above the lower housing. Terms such as upper, lower, above and below are used described the relative positions of components and are not intended to indicate a quality or locational requirement since the cylinder can be oriented in any position relative to the housing and crankshaft.

Figure 1:
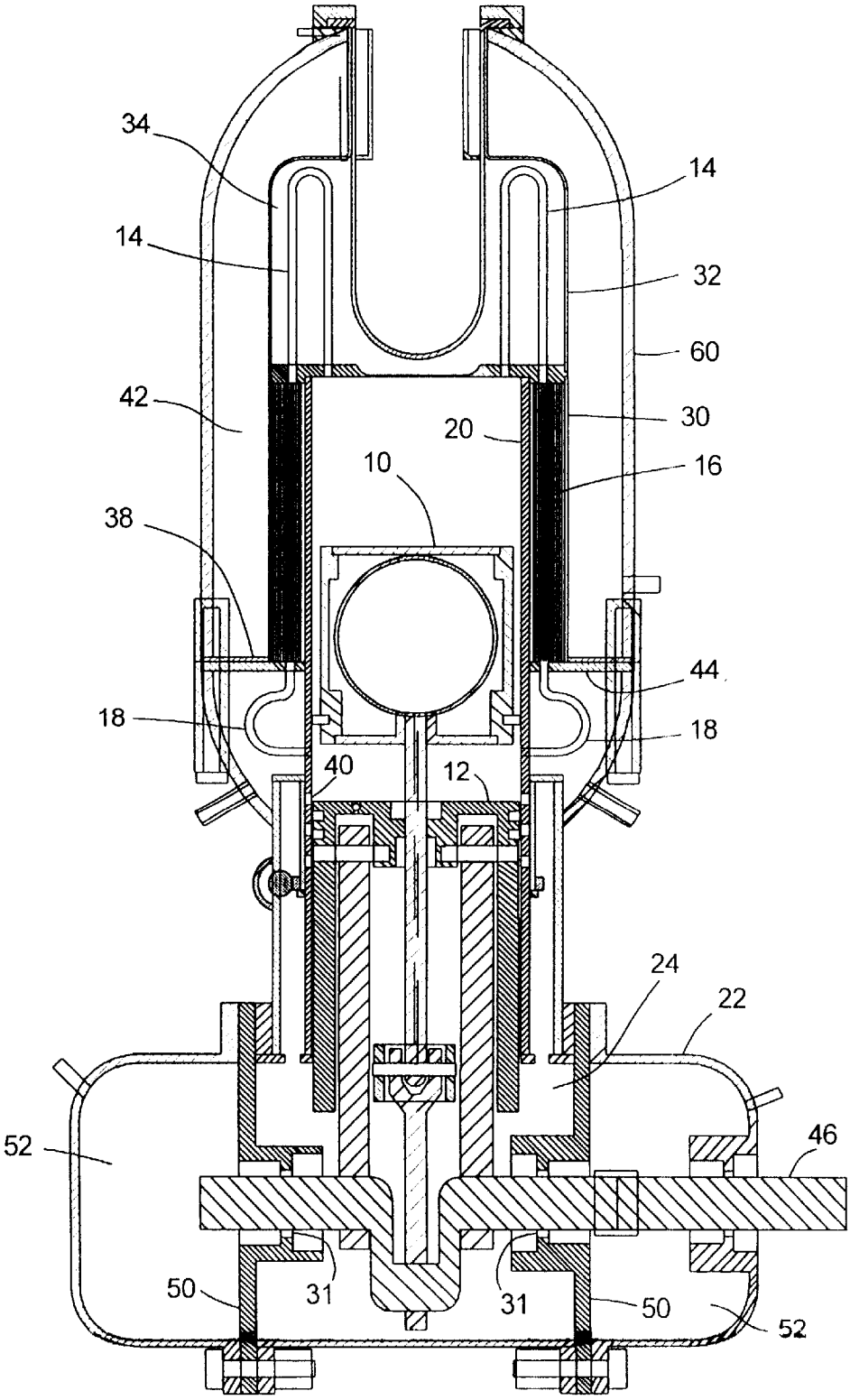
FIG. 1 is a longitudinal vertical cross sectional view showing the overall arrangement for a complete dual shell Stirling engine.

Referring to FIG. 1, components of a dual shell Stirling engine having a power piston 12 that drives an output crankshaft 46 are illustrated. A working fluid, such as Helium gas, is contained in cylinder 20 above power piston 12 and is shuttled through heat transfer tubing 14, regenerator 16, and cooling pipes 18 by the action of a displacer piston 10. An inner shell 30 surrounds the heat transfer tubing 14 and regenerator 16. The upper portion 32 of inner shell 30 contains a liquid metal region 34 filled with a thermally conductive liquid metal, such as silver, which surrounds the heat transfer tubing 14. The regenerator 16 is preferably a coiled annulus of thin material disposed between cylinder 20 and inner shell 30. Outer shell 60 surrounds inner shell 30 and acts as a pressure vessel. The inner shell 30, outer shell 60 and flange 38 bound a pressure backup region 42. The pressure backup region is filled preferably with an insulating liquid material to provide pressure backup against inner shell 30 and, consequently through liquid metal region 34, to heat transfer tubing 14.

Lower housing 22 has a reservoir area 24 between a pair of crankshaft end plates 50 which acts as a reservoir for the working fluid and is in fluid communication with the working fluid in cylinder 20 through throttle ports 40 in cylinder 20. Low pressure seals and bearings 31 prevent the working fluid in reservoir area 24 from escaping into the space 52 outside of crankshaft end plates 50, which is preferably pressurized with ambient air to approximately the same pressure as that in reservoir area 24. Throttling is accomplished by controlling the openings of throttle ports 40 in cylinder 20.

Whether the engine is operating at full throttle or part throttle, the power produced and the efficiency at which it is produced depend largely on the functioning of the regenerator 16, which is a heat sink for the working fluid passing between the heat transfer tubing 14 and the cooling pipes 18. When the heated working fluid passes from the heat transfer tubing 14 to the cooling pipes 18, heat is transferred from the working fluid into the regenerator 16; and when the cooled working fluid passes back the other way, heat is transferred from the regenerator to the working fluid. The more efficient this heat transfer, the more efficient is the power produced by the engine.

A way to picture the function of the regenerator 16 is to visualize the regenerator as a series of narrow constant-temperature heat sink regions stacked on top of one another inside the regenerator. The temperature of the top of the regenerator is that of the liquid metal region 34. The temperature at the bottom of the regenerator is that of the cooling fluid. If the working fluid were to flow very slowly through each temperature region so that the working fluid adjusts its temperature to match the local regenerator temperature, and if the working fluid accomplished this without a pressure drop as it passed through the regenerator, then a perfect regenerator would be achieved which minimizes the losses as the working fluid gets moved between the regions above and below the displacer piston 10. The regenerator thus needs to have very low thermal conductivity in the fluid flow direction since one end of the regenerator is hot and the other end is cold. The regenerator also should have very high thermal conductivity in the direction normal to the fluid flow so that the working fluid can rapidly adjust itself to the local temperature inside the regenerator. The regenerator must also have a very large surface area to improve the rate of heat transfer with the working fluid. Finally the regenerator must provide a low-loss flow path for the working fluid so that minimal pressure drop will result as the working fluid moves through.

The improved regenerators 6 is preferably designed as a coiled annulus to absorb the same heat quantities as a mesh regenerator but without the large pressure drop associated with the mesh system. This increases the total Stirling engine efficiency while allowing very high heat transfer rates. The annular shape has the further advantage of operating with a reduced frontal area relative to a conventional mesh system. The frontal area of the annular regenerator more closely matches the heater tube and cooling tube areas. This eliminates the losses associated with the convergent and divergent ducting regions generally required on large regenerator area systems, and further improves power produced and increases engine efficiency by reducing the dead volume in the system.

Figure 2:
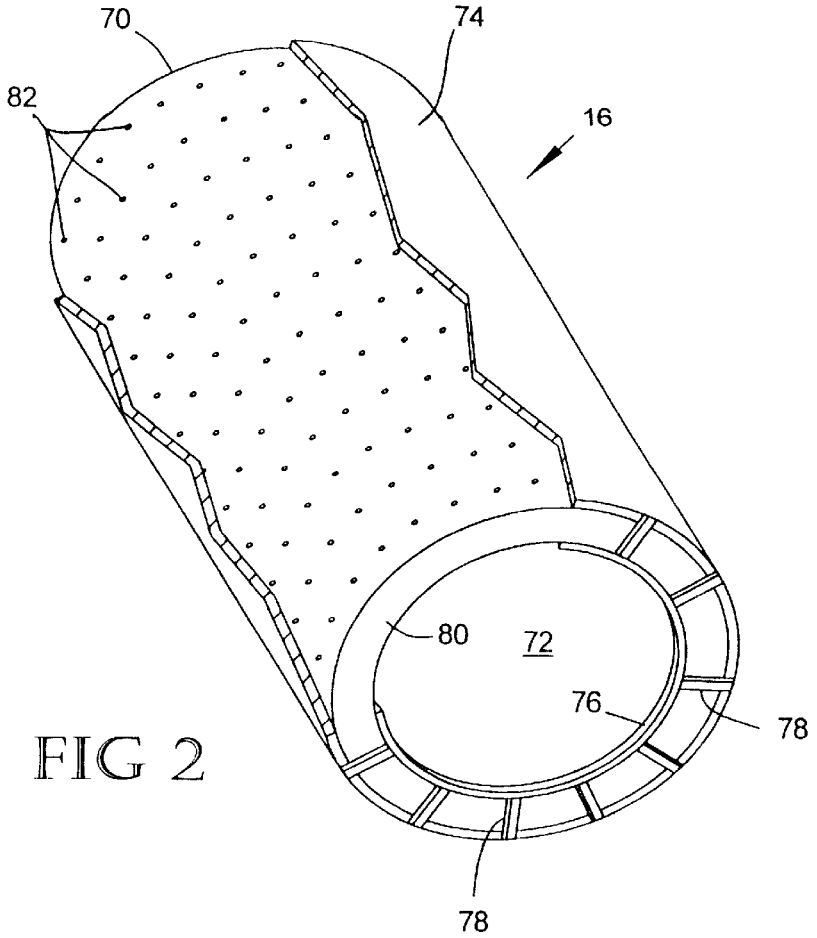
FIG. 2 is a perspective view of a regenerator cartridge with the inner and outer sleeves shown cut away to expose the surface of the coiled annulus.

Referring to FIG. 2, the regenerator of the present invention includes a coiled annulus 70 of thin material that is preferably contained in a cartridge having inner sleeve 72, an outer sleeve 74, and a cage base 76 at its lower end with a plurality of bars 78 that function as standoffs to space the bottom end 80 of coiled annulus 70 off of cooling flange 44 (shown in FIG. 1). Cage base 76 is a substantially open structure so as to minimally interfere with flow of the working fluid across it, and is preferably permanently attached to sleeves 72 and 74 such as by brazing.

In one embodiment, coiled annulus 70 is made of thin metal foil such as 321 stainless steel approximately 0.002 inches thick. Stainless steel is the preferred metal because it can be readily worked and handled without damage, it does not erode or corrode in the flow of the working fluid, it has good durability and sufficient high temperature capability. Its drawback, as with any metal, is that it is relatively thermally conductive compared to other nonmetallic materials.

The working fluid flows through spaces provided between each coil of coiled annulus 70. To provide the spacing between the coils, the foil has embossments, such as a plurality of dimples 82, at regular intervals. The dimples protrude out one side of the foil and extend approximately 0.008 inches from the foil surface. As the foil is wound into the spiral shaped coiled annulus, the protruding dimples space each coil of foil a uniform distance. The protruding dimples can be made by passing the foil between a roller having a plurality of spikes extending from its surface and a backup material, such as a hard rubber roller or a mating roller. The spikes are preferably blunt so that the dimples do not perforate the foil, but perforating the foil is not detrimental to the function of the regenerator. The protruding dimples are preferably arranged in a rectangular array so that dimples are aligned axially, which minimizes disruption to flow of the working fluid. Dimple spacing is preferably approximately ¼ to ½ inch in both directions, but it may be any other suitable spacing. Other dimple arrangements may be used, including random placement, at more or less spacing. Adequate dimples in prototype regenerators were made simply by rolling a carpet tractor tool, typically used to work the joints of carpet, over the stainless steel foil.

The preferred foil thickness and protruding dimple height allow the coiled annulus to be wound and installed between sleeves 72 and 74 to produce a regenerator cartridge that has an optimal porosity. Too little porosity provides too much resistance to flow of the working fluid, resulting in power loss in the engine. Too much porosity may not provide enough thermal mass to be effective, and thereby also reduces power produced by the engine.

Figure 3:
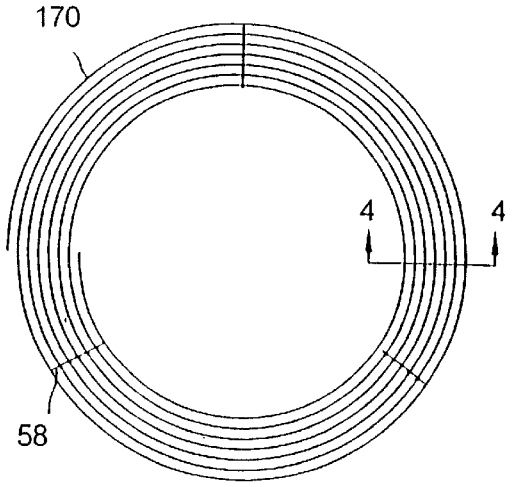
FIG. 3 is a schematic illustration of a top plan view of a coiled annulus of the regenerator.

Referring to FIG. 3, another embodiment of the coiled annulus 170 is made of a nonmetallic material, preferably a carbon carbon material commonly referred to as graphite. Graphite's high temperature capability and strength make it suitable as a regenerator material. It also has a very low coefficient of expansion which reduces thermal stresses. The graphite material has a much lower axial thermal conductivity than the stainless steel foil, but it is susceptible to erosion in the flow of the working fluid, and is very fragile this thin. Individual graphite coils may be less than 0.01 inches thick with a gap between coils of approximately 0.005 inches. The graphite material has carbon fibers oriented circumferentially around the coiled annulus 170, or at a small helix angle, providing a thermal conductivity in the fiber direction over 100 times that of the direction perpendicular to the fibers across the carbon matrix. Since the carbon fibers run almost perpendicular to the fluid flow, the coiled anulus 170 has very high thermal conductivity around it but very low conductivity in the flow direction. The regenerator operates more efficiently with very low conductivity in the fluid direction; i.e. up or down. The large heat transfer rates perpendicular to the fluid direction allow the fluid to transfer energy to and from the regenerator efficiently.

The coiled annulus 170 is made by laying up a prepreg uni-axial carbon fiber composite tape, at a small helix angle relative to perpendicular, on a non-stick backing material, such as a Boron Nitride coated steel coil. The steel coil may be only 0.01 inches thick, a little wider than the regenerator length and several feet long. The helix angle is variable, but is typically 5 to 15 degrees. A second layer of prepreg uni-axial tape is applied over the first layer but with the helix angle opposite that of the first layer. The resulting layup would have the fibers running approximately + or a − few degrees relative to the direction perpendicular to the flow of the working fluid. The plus and minus helical angle for the fibers adds strength to the resulting carbon carbon material. However, it is possible that sufficient strength may also be achieved with fibers at zero degrees, or perpendicular to the flow. Once the layup is cured and baked to remove the resins, which are converted to a carbon material and thereby form a Carbon-Carbon matrix, they are unwrapped from the steel coil and formed into a loose annular coil.

Figure 4:
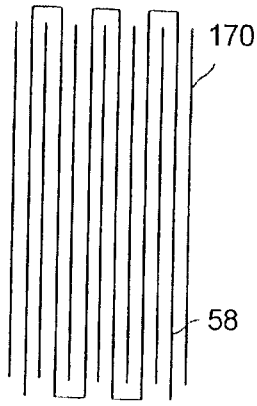
FIG. 4 is a section view taken along line 4—4 of FIG. 3.

Referring also to FIG. 4, spacers are put between each coil to maintain an annular gap between each coil. A low thermally conductive material, such as a ceramic string 58, is preferred for the spacer. The ceramic string 58 is preferably woven through the regenerator coils, preferably radially across the annulus, at a minimum of three locations. The string is preferably continuous at each location, thus securing the coils relative to each other. A layer of insulation is placed between the regenerator 16 and the cylinder 20 Alternatively, the regenerator annulus could be fabricated of concentric graphite cylinders, again with the fibers running approximately perpendicular to the fluid motion. Such a configuration also uses channels for fluid flow and heat transfer. The fiber materials could be carbon, graphite, Boron Carbide, Boron Nitride, or Silicon Carbide or a number of metals such as Tantalum, Molybdenum, or Tungsten. The matrix could be carbon, Boron, ceramic oxides, or Borides. The regenerator could be coated with various surfaces for heat transfer, corrosion protection, or erosion protection. An example of a surface coating would be a thin layer of Boron Carbide, or Boron Nitride, or Silicon Carbide. Other metals or ceramics could be used for the fibers or the matrix. Also a combination of fibers or matrix materials could be used. The regenerator sheets could be porous and tilted a few degrees to the flow so that the flow would have to cross the sheet surface boundaries; flowing through the surface could enhance heat transfer. Other materials with a thermal bias could be used such as graphite plate or other fiber mixes.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. A multi-channel thermal regenerator for a heat engine, comprising:

a coiled annulus of thin high-temperature flat sheet material coiled so that individual coils are in spaced substantially parallel arrangement in an annular configuration, the opposite surfaces of said adjacent coils forming continuous annular channels therebetween for moving fluid therethrough; and a device for maintaining the spaced substantially parallel arrangement of the coils, such that heat is transferred between a fluid moving through the channels and the coils with a minimum pressure drop in the fluid.

2. The regenerator of claim 1, wherein the sheet material is metal.

3. The regenerator of claim 2, wherein the metal is stainless steel.

4. The regenerator of claim 2, wherein the sheet material is approximately 0.002 inches thick.

5. The regenerator of claim 2, wherein the device for maintaining the spaced substantially parallel arrangement of the coils is a plurality of spaced discrete embossments on the sheet material.

6. The regenerator of claim 5, wherein the embossments are protruding dimples.

7. The regenerator of claim 6, wherein the dimples protrude approximately 0.008 inches from the sheet material.

8. The regenerator of claim 6, wherein the dimples are arranged in rectangular arrays on the sheet material so that dimples align axially to minimize disruption to flow of the fluid and to maintain continuous annular channels.

9. The regenerator of claim 1, further comprising a cartridge containing the coiled annulus.

10. The regenerator of claim 9 wherein the cartridge comprises an inner sleeve, an outer sleeve in spaced parallel arrangement from the inner sleeve with the coiled annulus being disposed therebetween, and a cage base connected between the inner sleeve and outer sleeve at one end of both sleeves, the cage base being substantially open with a plurality of bars adjacent an end of the coiled annulus for spacing the end of the coiled annulus from an engine structure against which the cartridge is installed.

11. The regenerator of claim 1, wherein the sheet material is carbon having a plurality of fibers oriented generally circumferentially around the coiled annulus, the material having a higher thermal conductivity in a direction along axes of the fibers.

12. The regenerator of claim 11, wherein the device for maintaining the spaced substantially parallel arrangement of the coils is a ceramic string interspersed between the coils.

13. The regenerator of claim 12, wherein the ceramic string is woven between the coils radially across the annulus at a plurality of locations around the annulus.

14. The regenerator of claim 13, wherein the string at each location is continuous.

15. A multi-channel thermal regenerator for a heat engine, comprising:

a coiled annulus of flat stainless steel sheet material embossed with rectangular arrays of spaced discrete protruding dimples and coiled so that individual coils are placed in spaced substantially parallel arrangement in an annular configuration by the protruding dimples, the opposite surfaces of said adjacent coils forming substantially unobstructed continuous annular channels therebetween for moving fluid therethrough such that heat is transferred between a fluid moving through the channels and the coils with a minimum pressure drop in the fluid; and a cartridge containing the coiled annulus, the cartridge having an inner sleeve, an outer sleeve in spaced parallel arrangement from the inner sleeve with the coiled annulus being disposed therebetween, and a cage base connected between the inner sleeve and outer sleeve at one end of both sleeves, the cage base being substantially open with a plurality of bars adjacent an end of the coiled annulus for spacing the end of the coiled annulus from an engine structure against which the cartridge is installed.

16. A multi-channel thermal regenerator for a heat engine, comprising:

a coiled annulus of thin flat carbon sheet material having a plurality of fibers oriented generally circumferentially around the coiled annulus, the material having a higher thermal conductivity in a direction along the axes of the fibers, the material being coiled so that individual coils are in spaced substantially parallel arrangement in an annular configuration, the opposite surfaces of said adjacent coils forming substantially unobstructed continuous annular channels for moving fluid therethrough; and a ceramic string woven between the coils radially across the annulus at a plurality of locations around the annulus to maintain the spaced substantially parallel arrangement of the coils such that heat is transferred between a fluid moving through the channels and the coils with a minimum pressure drop in the fluid.

17. A method of making a regenerator for a heat engine comprising the steps of:

embossing a thin sheet of metal to form a pattern of spaced discrete embossments that protrude a uniform amount from the surface of the sheet;

wrapping the embossed sheet about a longitudinal axis into a coiled annulus such that individual coils are spaced apart by the embossments; and locating said embossments to provide parallel axial flow paths and unobstructed continuous annular channels for a working fluid of the heat engine that minimize pressure losses and maximize thermal conductivity.

18. The method of claim 17, wherein the embossments formed are protruding dimples.

19. The method of claim 18, wherein the pattern of embossments is a rectangular array.

20. The method of claim 17 further comprising the step of installing the coiled annulus into a cartridge having a substantially open structure adjacent an end of the coiled annulus; and maintaining the end of the coiled annulus spaces from an engine structure against which the cartridge is installed.

* * * * *

UNITED STATES PATENT AND TRADEMARK OFFICE

CERTIFICATE OF CORRECTION

PATENT NO. : 6,526,750 B2 
DATED : March 4, 2003
INVENTOR(S) : Wayne T. Bliesner, Brian J. Bileau and Gerald R. Fargo It is certified that error appears in the above-identified patent and that said Letters Patent is hereby corrected as shown below:

Column 8,
Line 46, change "a rectangular array" to -- rectangular arrays --.

Signed and Sealed this

Sixth Day of May, 2003

JAMES E. ROGAN
*Director of the United States Patent and Trademark Office*